US009403397B2

(12) United States Patent
Chiang

(10) Patent No.: US 9,403,397 B2
(45) Date of Patent: Aug. 2, 2016

(54) SEMI-AUTOMATIC BOOK SEWING MACHINE

(71) Applicant: CHUNG SHEEN TECHNOLOGY CO., LTD., Taichung (TW)

(72) Inventor: Chou-Chih Chiang, Taichung (TW)

(73) Assignee: Chung Sheen Technology Co., Ltd., Taichung (TW)

( * ) Notice: Subject to any disclaimer, the term of this patent is extended or adjusted under 35 U.S.C. 154(b) by 84 days.

(21) Appl. No.: 14/532,889

(22) Filed: Nov. 4, 2014

(65) Prior Publication Data

US 2016/0121637 A1 May 5, 2016

(51) Int. Cl.
*B42B 5/12* (2006.01)

(52) U.S. Cl.
CPC .. *B42B 5/123* (2013.01); *B42B 5/12* (2013.01)

(58) Field of Classification Search
CPC ..... B42B 5/12; B42B 5/123
USPC ..... 412/38; 140/92.3, 92.93, 92.94
See application file for complete search history.

(56) References Cited

U.S. PATENT DOCUMENTS

| | | | | |
|---|---|---|---|---|
| 4,378,822 | A * | 4/1983 | Morris | B42B 5/123 140/92.3 |
| 6,036,423 | A * | 3/2000 | Westra | B42B 5/123 412/38 |
| 6,773,216 | B2 * | 8/2004 | Crudo | B42B 5/103 412/38 |
| 2009/0229698 | A1 * | 9/2009 | Chiang | B42B 5/123 140/92.3 |
| 2009/0242068 | A1 * | 10/2009 | Chiang | B42B 5/126 140/92.3 |
| 2014/0017039 | A1 * | 1/2014 | Chiang | B42B 5/12 412/16 |

* cited by examiner

*Primary Examiner* — Kyle Grabowski
(74) *Attorney, Agent, or Firm* — Tracy M. Heims; Ruth Lynette Wylle; Apex Juris, pllc

(57) ABSTRACT

A semi-automatic book sewing machine comprises a base and an actuation device, wherein the actuation device comprises: a mobile platform glidingly contacts a base; a rotary drum driven to spin locally by a motor; a bottom panel installed on the mobile platform's bottom and having a panel fixture block at one side; a manual adjustment kit used in driving the mobile platform and the bottom panel for displacement; two slip joint plates glidingly contacting the base and the mobile platform; a linkage connected between two slip joint plates; at least a push-pull member connected to the linkage for outward and inward movements back and forth; a binder plate pivotally fitted at the linkage and communicating with the push-pull members for pivotal compression and separation under the effect of the push-pull members.

7 Claims, 20 Drawing Sheets a b

SEMI-AUTOMATIC BOOK SEWING MACHINE

BACKGROUND OF THE INVENTION

1. Field of the Invention

The present disclosure relates to a book sewing machine, particularly a semi-automatic book sewing machine.

2. Description of the Prior Art

A book sewing machine is a conventional device to wind a spiral coil at the lateral side of a stack of paper.

Conventional book sewing machines are divided into two types: the full-automatic book sewing machine based on full-automatic control for convenient operation features bulky volume and numerous costly components which occupy more space and impose financial burden on a small enterprise or company not specializing in book publishing; the full-manual book sewing machine features advantages such as small volume, fewer components, less space requirement, inexpensiveness and full-manual operation but disadvantages like strenuous effort and time consuming operation which are inconvenient to a small enterprise or company occasionally binding stacks of paper.

Furthermore, resources may be wasted in more than one book sewing machine purchased by a company owner, which requires spiral coils different in diameter to be wound on stacks of paper, because either a full-automatic book sewing machine or a full-manual book sewing machine is applicable to one type of spiral coil with a single dimension.

SUMMARY OF THE INVENTION

For development of an alternative book sewing machine which is distinct from a conventional one, characteristic of less space requirement, fewer components and convenient use, and applicable to spiral coils different in diameter, a semi-automatic book sewing machine in the present disclosure comprises: a base with a book storage region, a spiral coil storage region and a coiling rack thereon and a base fixture block at one side; an actuation device with a mobile platform, a motor, a rotary drum, a bottom panel, a manual adjustment kit, two slip joint plates, a linkage, at least a push-pull member, a binder plate and a touch switch. The mobile platform which is opposite to and glidingly contacts the base has a first elliptical hole; the motor is installed on the mobile platform for output of a rotary force; the rotary drum mounted on the mobile platform and connected to the motor is driven to spin locally by the motor; the bottom panel installed on the bottom of the mobile platform develops a second elliptical hole and comprises a panel fixture block at one side; the manual adjustment kit comprising a shaft, a first cam eccentrically connected to the shaft and held in the first elliptical hole, a second cam eccentrically connected to the shaft and held in the second elliptical hole, and a rotary knob connected to and coacting with the shaft is used in driving the mobile platform and the bottom panel for displacement; the two slip joint plates glidingly contact both the base and the mobile platform; the linkage is connected between the two slip joint plates; the two push-pull members are connected to the linkage for outward and inward movements back and forth; the binder plate pivotally fitted at the linkage communicates with the push-pull members for pivotal compression and separation under effect of the push-pull members; the touch switch installed on the mobile platform is used to control and deactivate the motor when the touch switch is contacted. As such, a semi-automatic book sewing machine which occupies less space and consists of fewer components can be easily operated and applicable to spiral coils of different diameters.

BRIEF DESCRIPTION OF THE DRAWINGS

Drawings disclosing illustrative embodiments of the present invention exemplifying advantages and objects thereof are, as follows.

DETAILED DESCRIPTION OF THE PREFERRED EMBODIMENT

Figure 1:
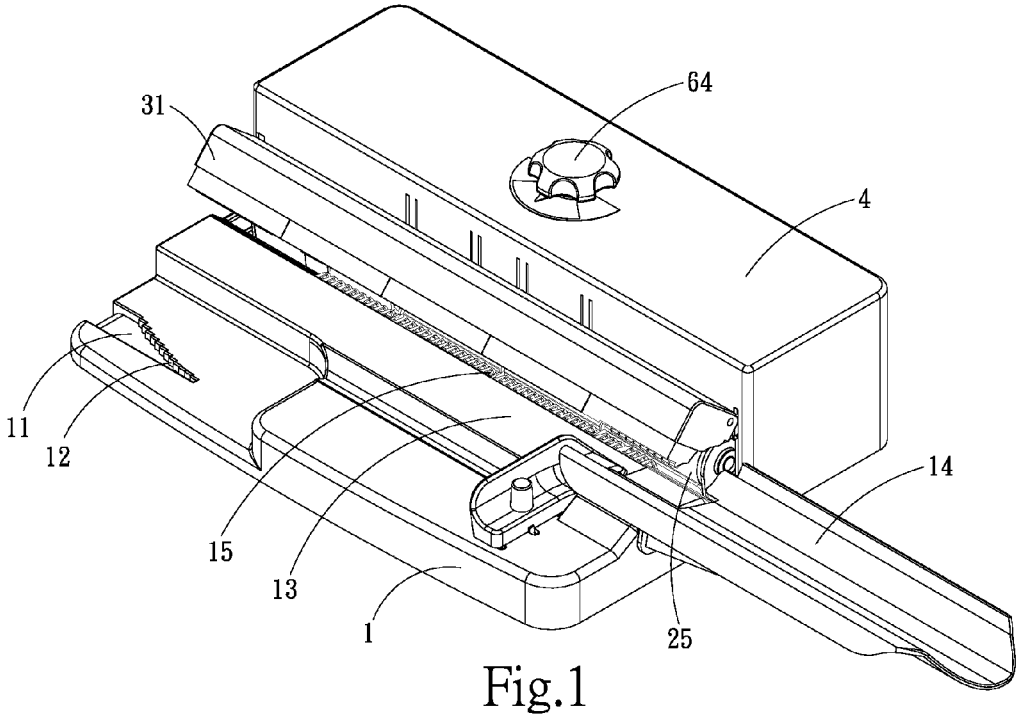
FIG. 1 is a perspective view illustrating a semi-automatic book sewing machine assembled in a preferred embodiment.
Figure 2:
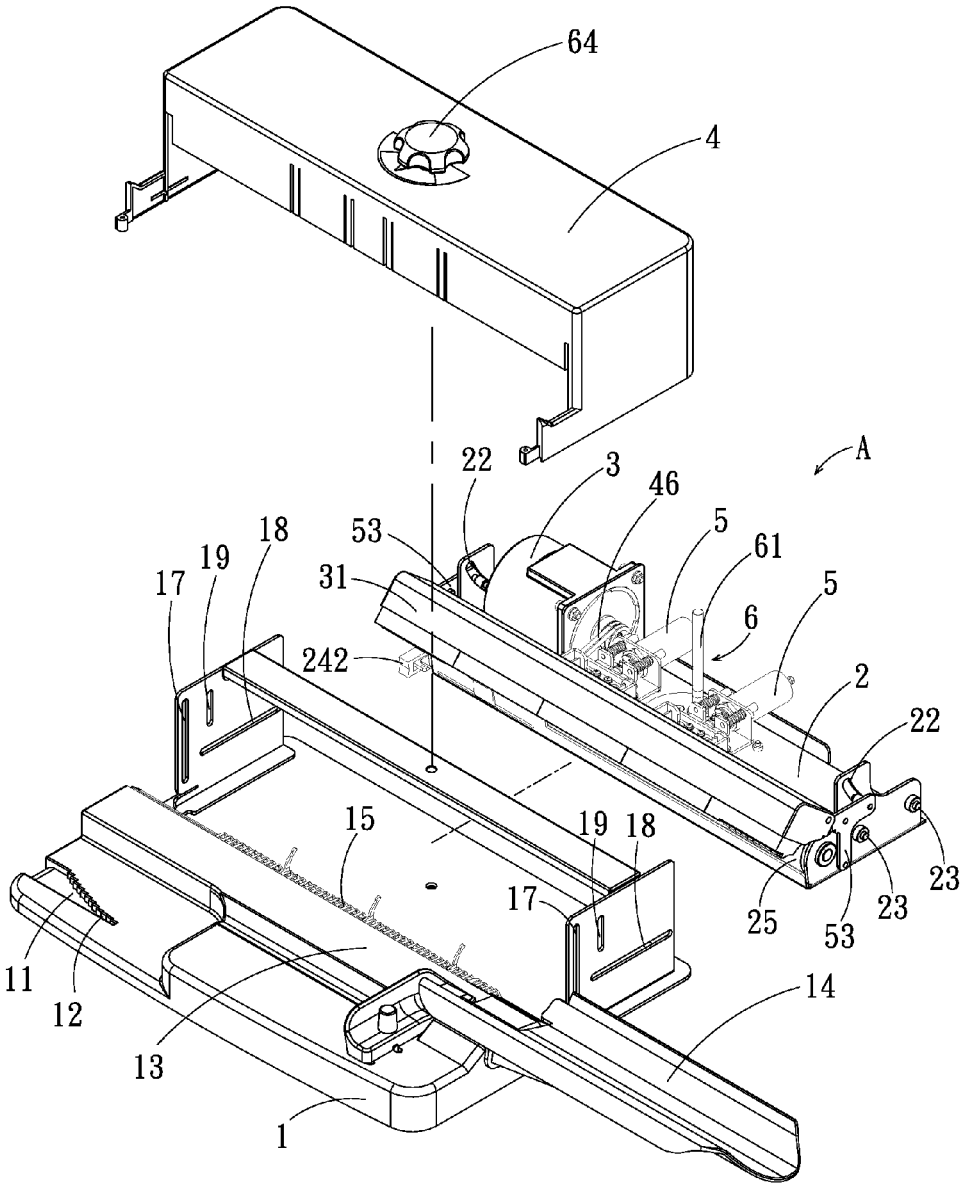
FIG. 2 is an exploded perspective view illustrating a semi-automatic book sewing machine in an embodiment.

A semi-automatic book sewing machine will be further illustrated with embodiments as well as accompanying drawings for clear understanding of its characteristics and distinguishing features.

Referring to FIG. 1 through FIG. 4 which illustrate a semi-automatic book sewing machine in a preferred embodiment comprises a base 1, an actuation device A and a housing 4:

Base 1 steadily placed on a plane (e.g., desktop) comprises a thickness measurement region 11 which consists of indents 12 varying in width and longitudinally linking one another, a book storage region 13, a spiral coil storage region 14, a coiling rack 15, and a base fixture block 16 at one side of base 1; base 1 further comprises longitudinal grooves 17(FIG. 2), transverse grooves 18 and lifting grooves 19 extending at both sides.

Figure 3:
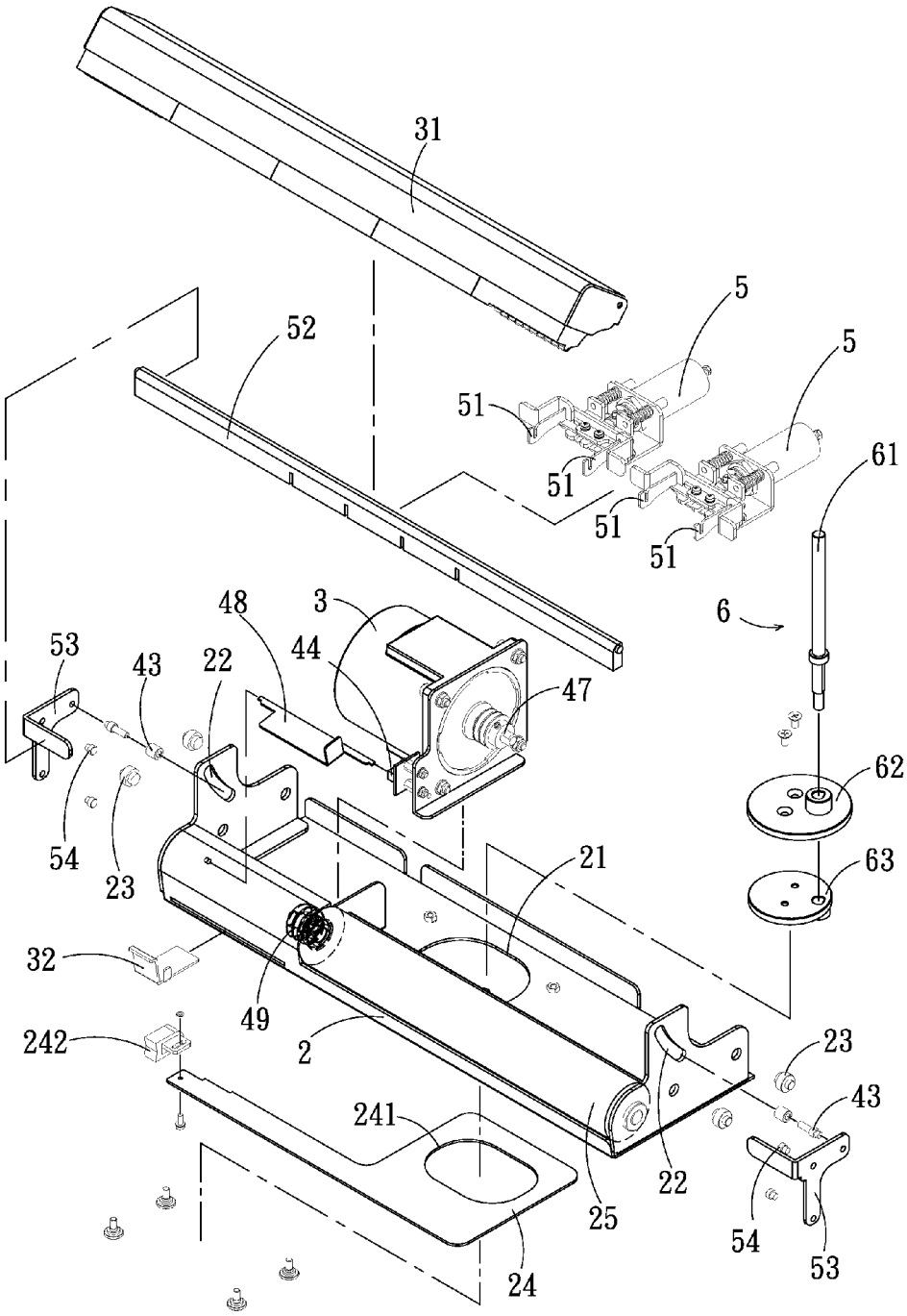
FIG. 3 is an exploded perspective view illustrating partial components of a semi-automatic book sewing machine in an embodiment.
Figure 4:
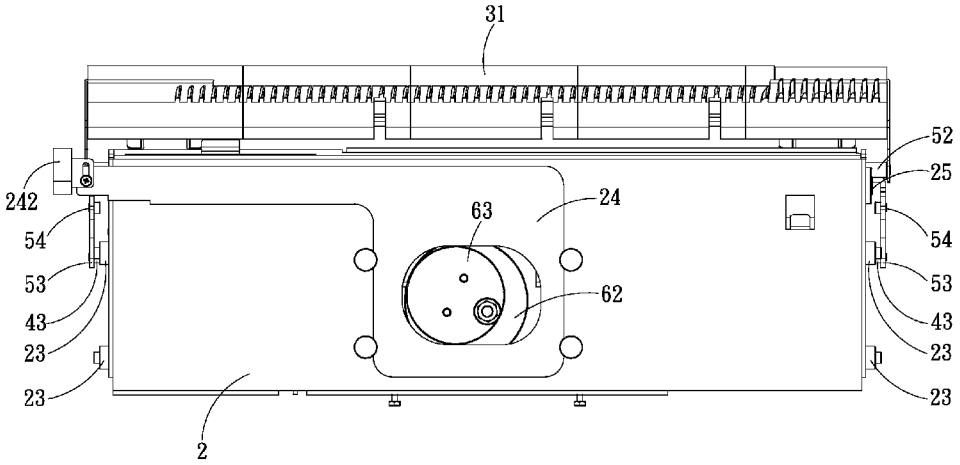
FIG. 4 is a bottom plan view illustrating partial components of a semi-automatic book sewing machine in an embodiment.
Figure 5:
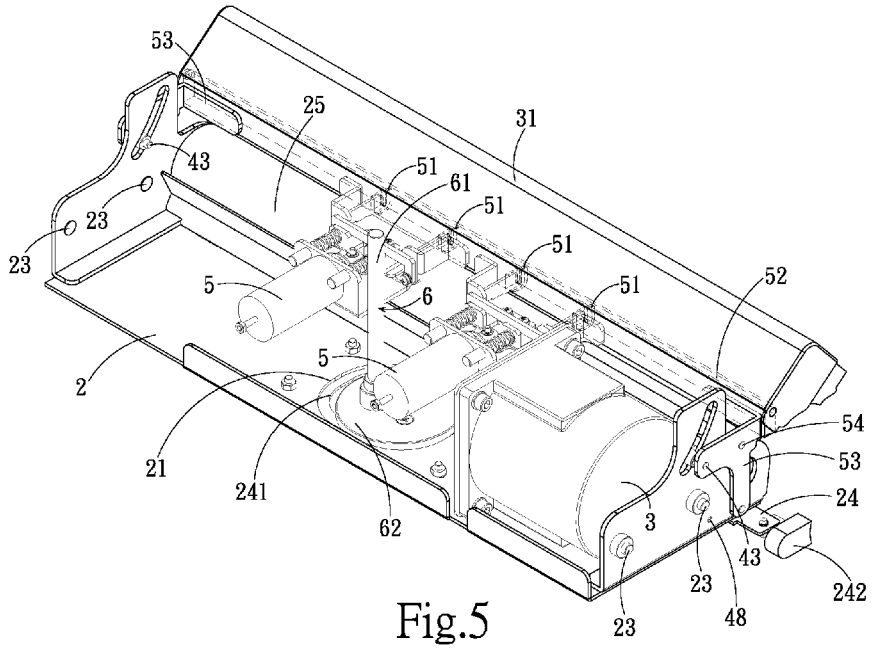
FIG. 5 is a perspective view illustrating partial components of a semi-automatic book sewing machine in an embodiment.

FIG. 3 illustrates the actuation device A installed on base 1. The actuation device A comprises a mobile platform 2, a motor 3, a rotary drum 25, a bottom panel 24, a manual adjustment kit 6, two slip joint plates 53, a linkage 52, two push-pull members 51, a binder plate 31 and a touch switch 32: the mobile platform 2 which is opposite to and glidingly contacts the base 1 has a first elliptical hole 21 and arc-shaped grooves 22 as well as transverse slippery columns 23 at both sides wherein each of transverse slippery columns 23 is glidingly held in one transverse groove 18 of base 1; motor 3 is installed on mobile platform 2 for output of a rotary force; rotary drum 25 mounted on mobile platform 2 and connected to motor 3 is driven to spin locally by motor 3; bottom panel 24 installed on the bottom of mobile platform 2 develops a second elliptical hole 241 and comprises a panel fixture block 242 (FIG. 4) at one side; manual adjustment kit 6 comprises a shaft 61, a first cam 62 eccentrically connected to shaft 61, a second cam 63 eccentrically connected to shaft 61, and a rotary knob 39 connected to and coacting with shaft 61 such that first cam 62 and second cam 63 are held in first elliptical hole 21 and second elliptical hole 241, respectively; two slip joint plates 53 allows two lifting studs 43 to slide in the two arc-shaped grooves 22 on mobile platform 2 and two lifting grooves 19 on base 1 simultaneously for curve movements along arc-shaped grooves 22 and vertical slides along lifting grooves 19; each of slip joint plates 53 comprises at least a longitudinal sliding stud 54 contiguously slipping in longitudinal groove 17 on base 1; linkage 52 is connected between two slip joint plates 53; two push-pull members 51 are connected to linkage 52 based on a default distance for outward and inward movements back and forth; binder plate 31 pivotally fitted at linkage 52 communicates with push-pull members 51 for pivotal compression and separation relative to linkage 52 under effect of push-pull members 51; touch switch 32 is installed on mobile platform 2 (FIG. 4).

Housing 4 mounted on base 1 is used to cover actuation device A; rotary knob 39 of actuation device A is rotationally installed on housing 4 and operated by a user.

Figure 6:
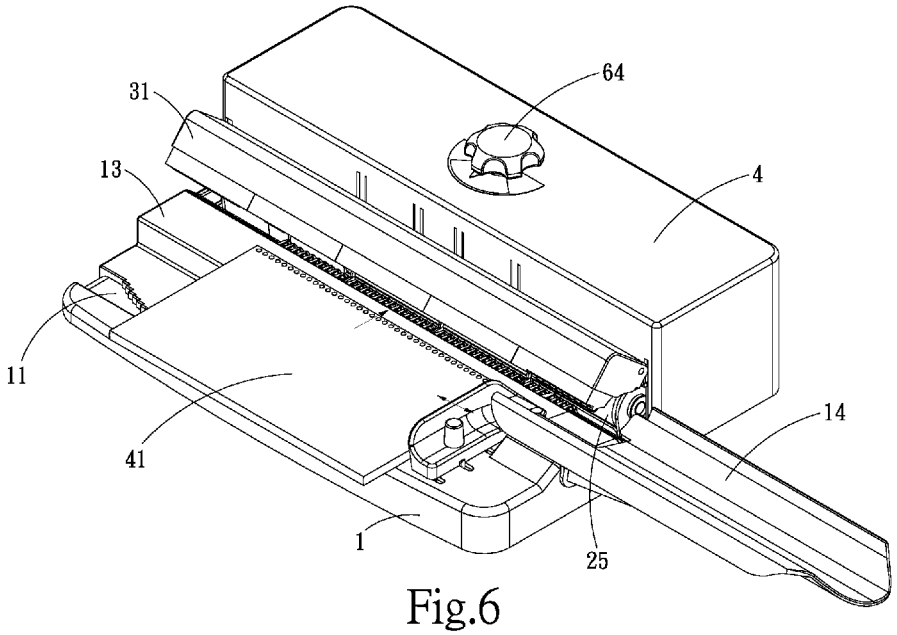
FIG. 6 is a schematic view illustrating paper placed on a semi-automatic book sewing machine.
Figure 7:
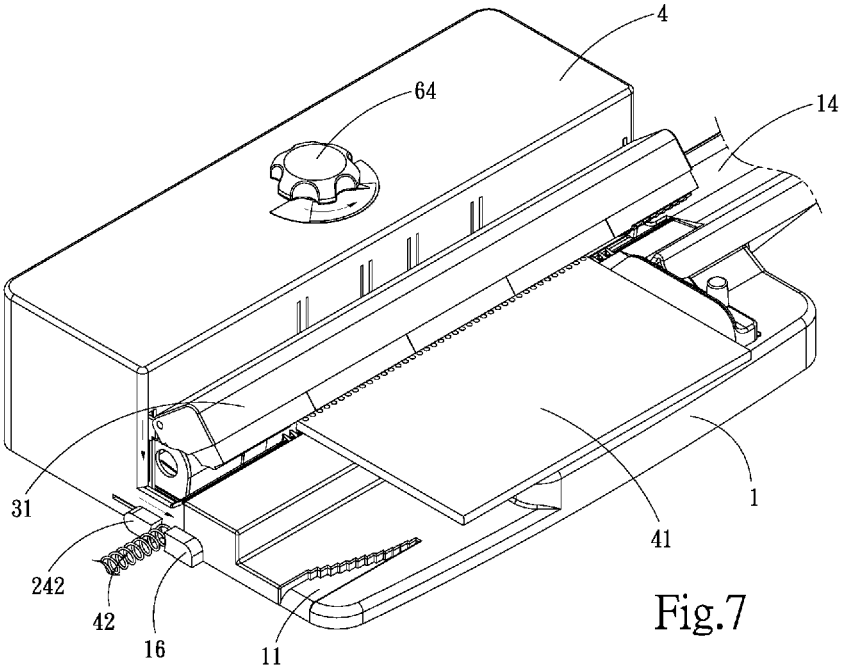
FIG. 7 is a schematic view which illustrates a spiral coil's diameter.
Figure 8:
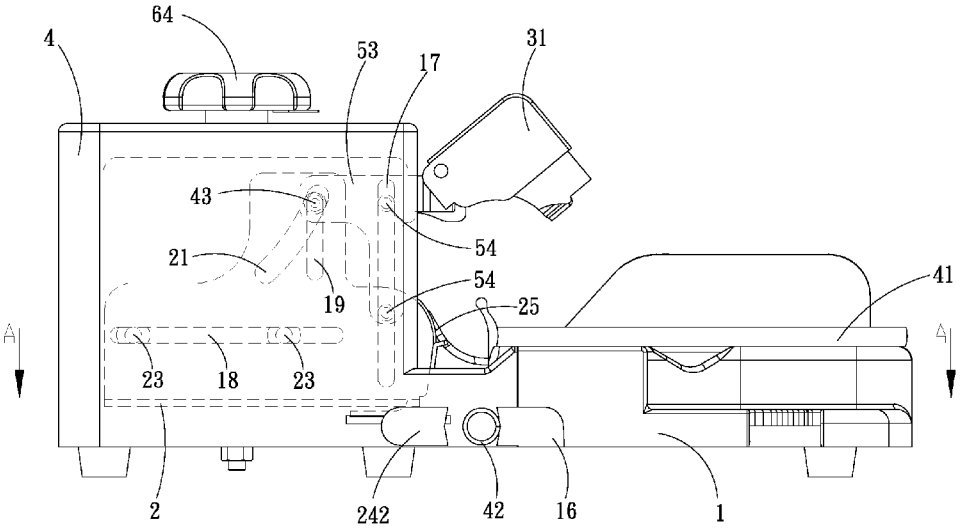
FIG. 8 is a side view of a semi-automatic book sewing machine.
Figure 9:
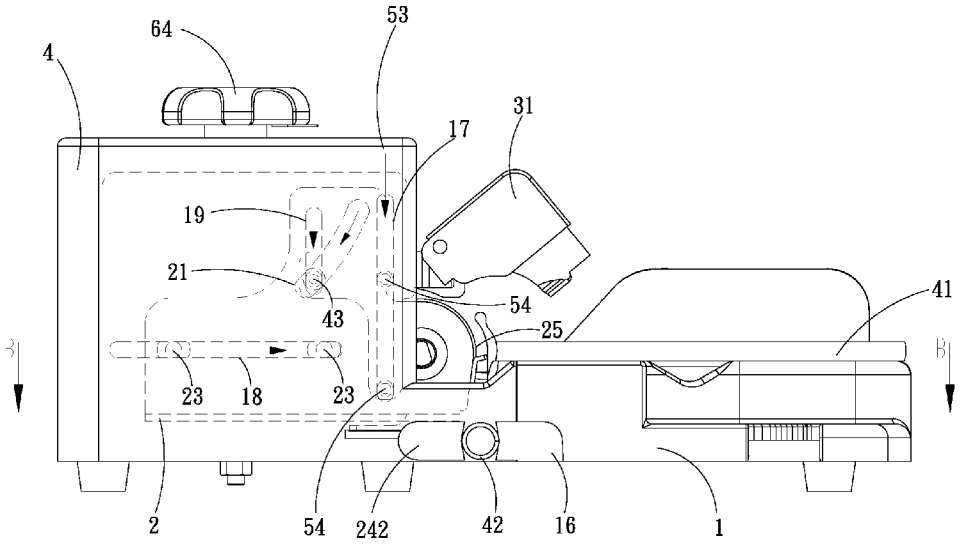
FIG. 9 is a side view which illustrates a semi-automatic book sewing machine is activated.

The above descriptions present components installed on a semi-automatic book sewing machine in a preferred embodiment. The characteristics of a semi-automatic book sewing machine in service are specified as follows:

A stack of paper 41 to be bound with a spiral coil should be placed on thickness measurement region 11 of base 1 for checking a thickness of stack of paper 41 and transferred to book storage region 13 (FIG. 6). A spiral coil 42 with a diameter matching the thickness of the stack of paper 41 is inserted between base fixture block 16 and panel fixture block 242 (FIG. 7). A user rotates rotary knob 39, driving first cam 62 as well as second cam 63 to spin by shaft 61 simultaneously and mobile platform 2 as well as bottom panel 24 to be shifted synchronously for translational movement of mobile platform 2 along transverse grooves 18 (FIGS. 8 and 9). Linkage 52, push-pull members 51, and binder plate 31 slide with slip joint plates 53 along arc-shaped grooves 22 (FIGS. 8 and 9) and make no translational movement related to active mobile platform 2; slip joint plates 53 vertically moving along lifting grooves 19 and longitudinal grooves 17 properly drive linkage 52, push-pull members 51 and binder plate 31 upward or downward (FIGS. 8 and 9). A user can stop rotating rotary knob 39 with both panel fixture block 242 and base fixture block 16 just contacting spiral coil 42.

Figure 10:
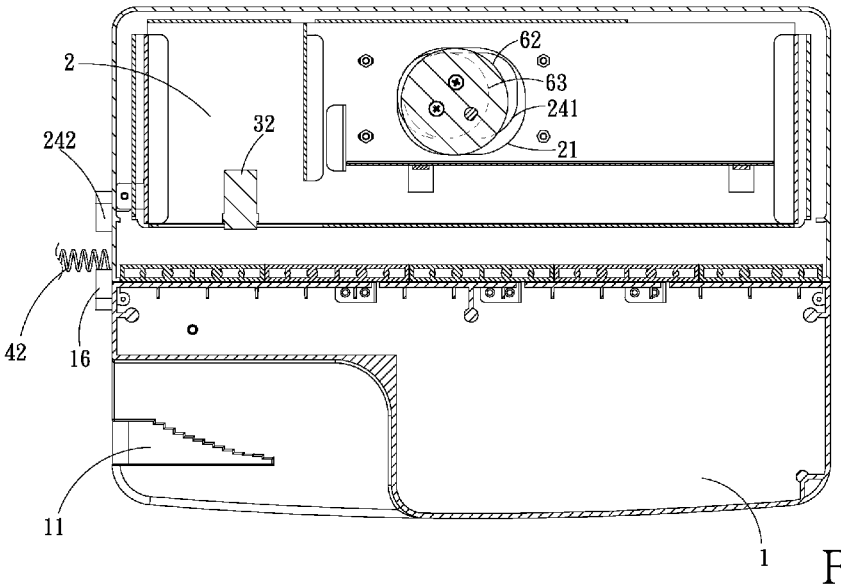
FIG. 10 is a sectional view for Section A-A in FIG. 6.
Figure 11:
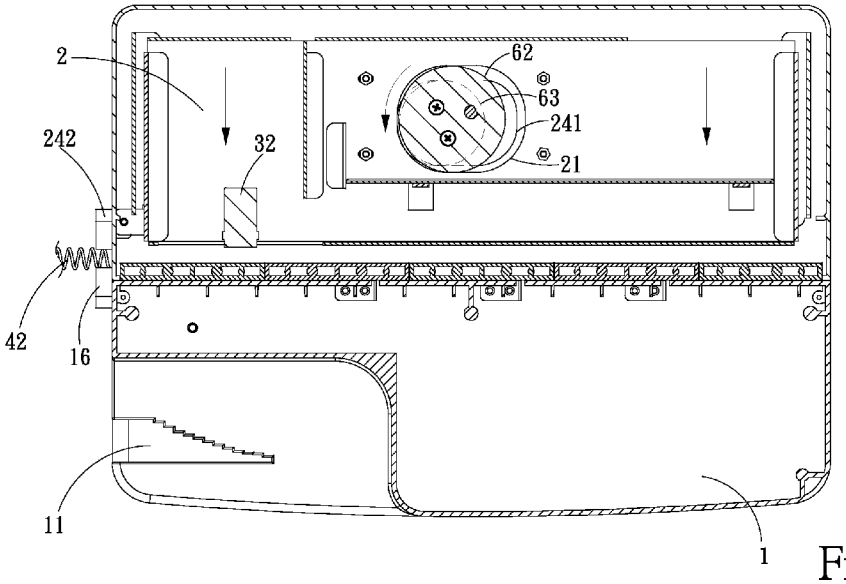
FIG. 11 is a sectional view for Section B-B in FIG. 7.
Figure 12:
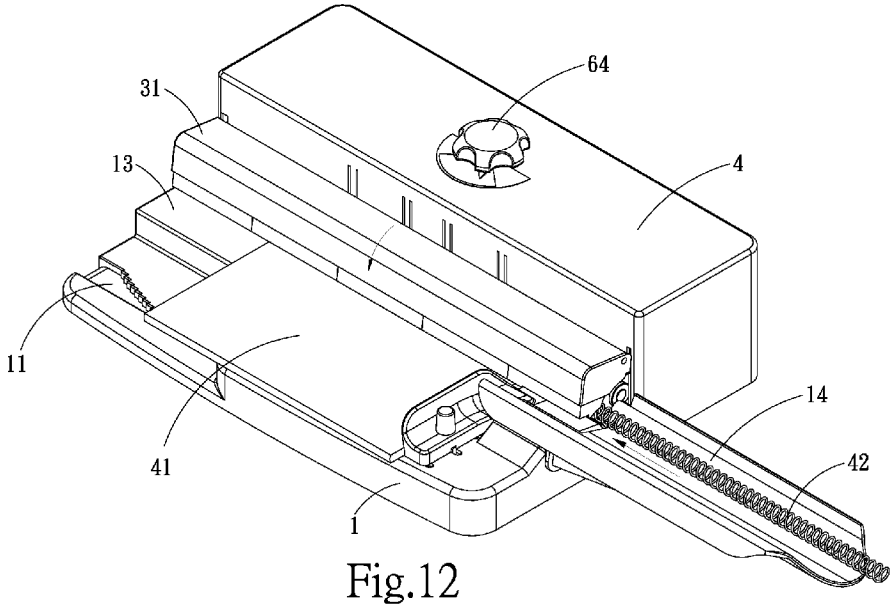
FIG. 12 is a schematic view which illustrates a spiral coil placed on a semi-automatic book sewing machine.
Figure 13:
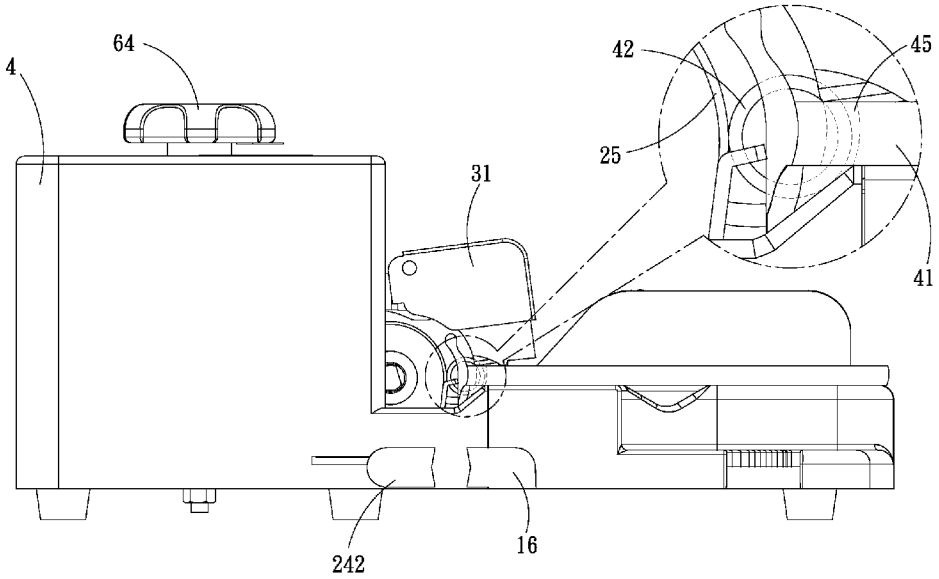
FIG. 13 is a side view along with a partial enlargement view of a semi-automatic book sewing machine.
Figure 14:
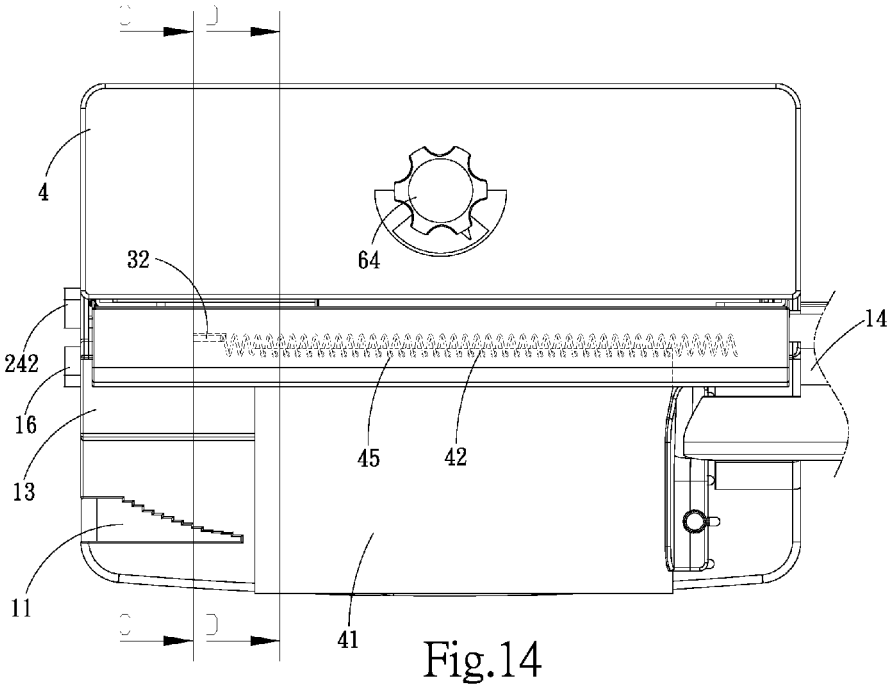
FIG. 14 is a top view illustrating a semi-automatic book sewing machine.
Figure 15:
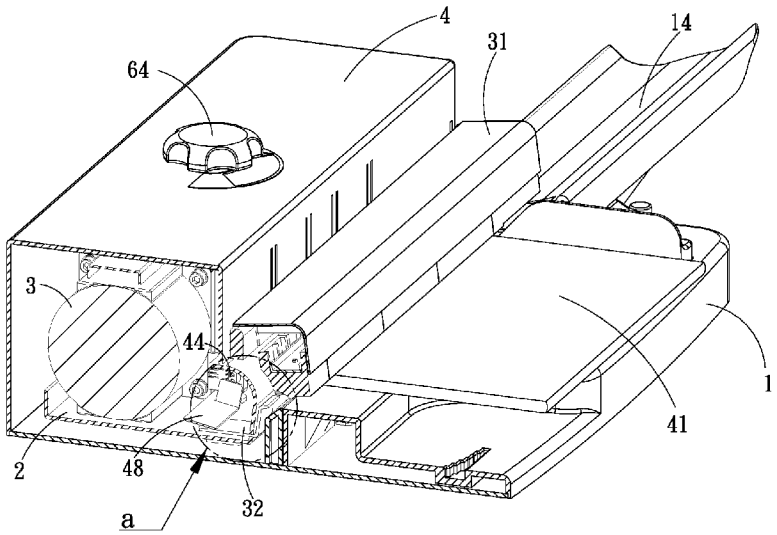
FIG. 15 is a sectional perspective view for Section C-C in FIG. 14.
Figure 16:
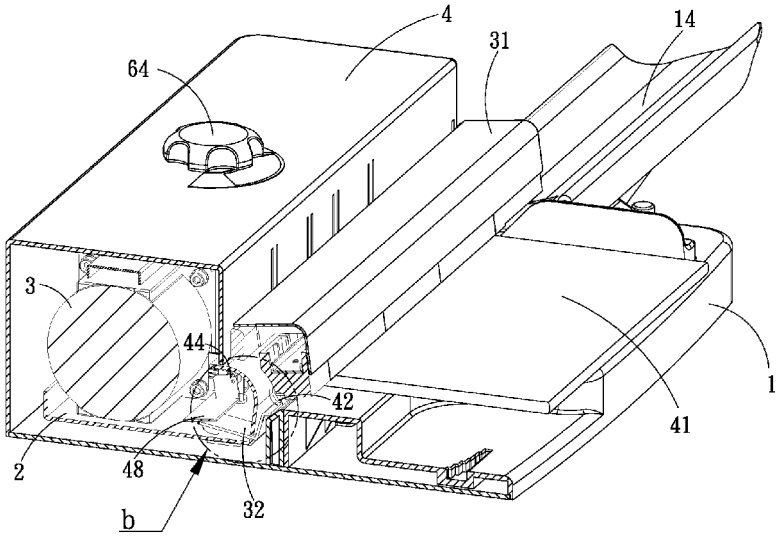
FIG. 16 is a sectional perspective view for Section C-C in FIG. 14 with a semi-automatic book sewing machine activated.
Figure 17:
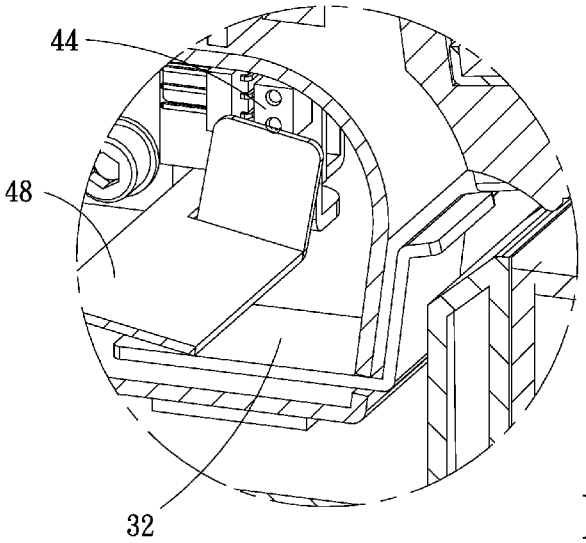
FIG. 17 is a partial enlargement view for "a" in FIG. 15.
Figure 18:
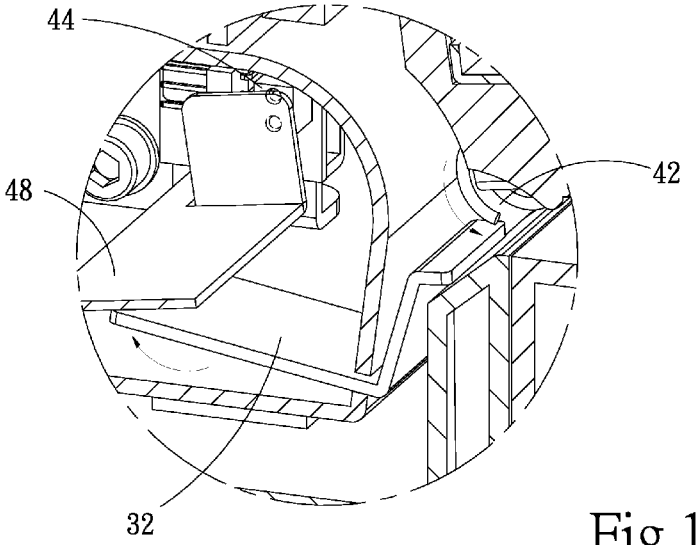
FIG. 18 is a partial enlargement view for "b" in FIG. 15 with some components activated.
Figure 19:
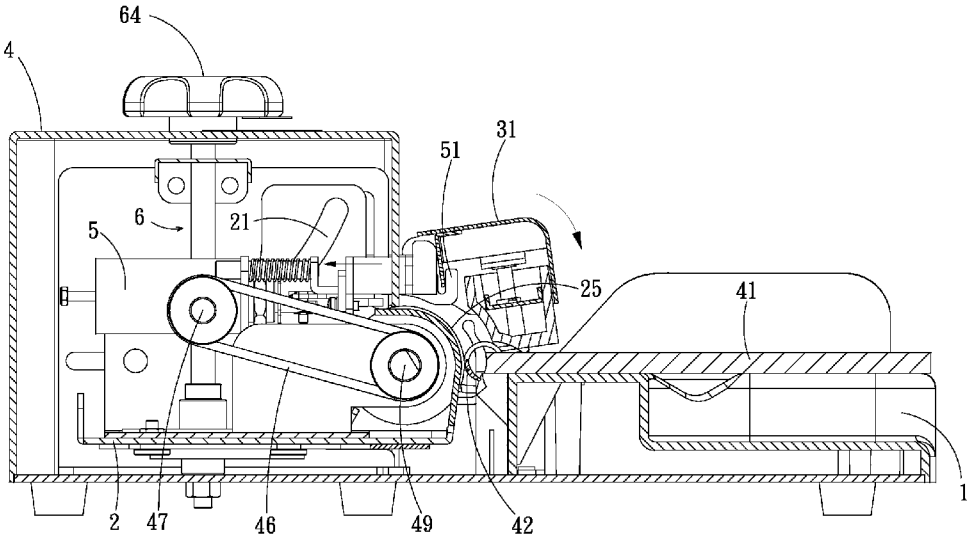
FIG. 19 is a sectional view for Section D-D in FIG. 14 with a semi-automatic book sewing machine activated.
Figure 20:
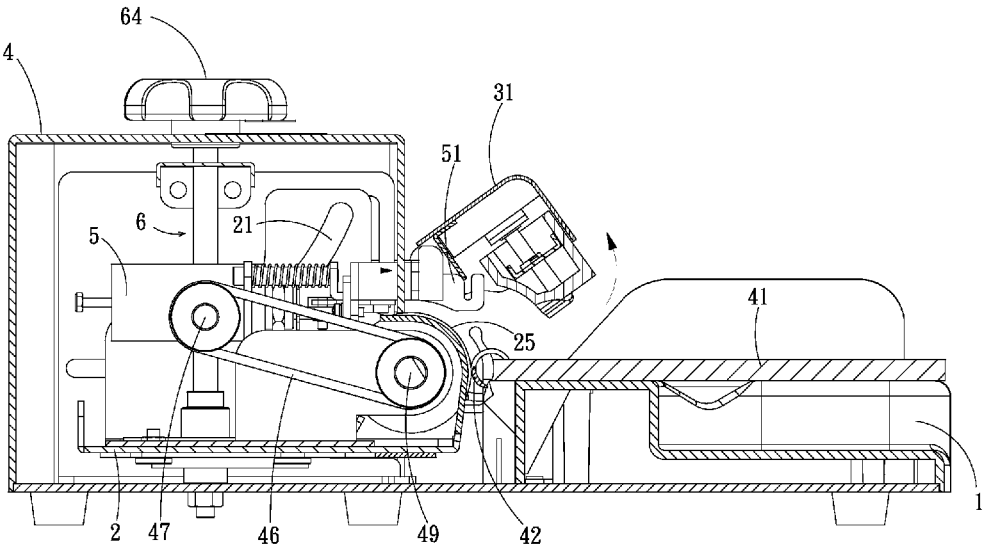
FIG. 20 is another sectional view for Section D-D in FIG. 14 with a semi-automatic book sewing machine activated.
Figure 21:
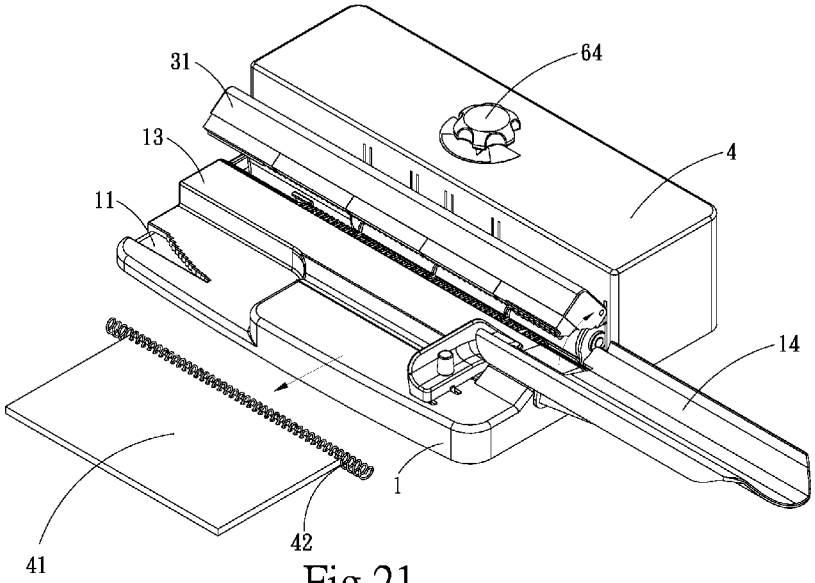
FIG. 21 is a schematic view which illustrates a semi-automatic book sewing machine in operation.

A user should place spiral coil 42 into spiral coil storage region 14 of base 1 (FIG. 10) and press an electric control switch (now shown in FIG. 10) so that push-pull members 51 drawn inward drive binder plate 31 to pivotally spin downward (FIGS. 10 and 11) and gently press spiral coil 42 on rotary drum 25 (FIG. 12). Motor 3 starts driving rotary drum 25 to revolve and lead spiral coil 42 to forward move rotationally along coiling rack 15 and penetrate thorough holes 45 on the stack of paper 41 (FIG. 13). Spiral coil 42 arriving at a default position resists touch switch 32 (FIG. 14) and deactivates motor 3 through active touch switch 32; push-pull members 51 retreating outward drive binder plate 31 to pivotally spin upward (FIG. 15). Finally, the stack of paper 41 bounded with spiral coil 42 can be taken from a book sewing machine (FIG. 16).

In present disclosure, a semi-automatic book sewing machine which features fewer components and reduced volume in contrast to a conventional full-automatic book sewing machine and needs less time and manpower in coiling compared with a conventional full-manual book sewing machine is a competitive tool with advantages of full-automatic and full-manual book sewing machines.

Moreover, a semi-automatic book sewing machine in present disclosure is used in binding stacks of paper of distinct thicknesses with spiral coils different in diameter and contributes to not only convenient use but also cost down because of no requirement for purchasing or book sewing machines used in stacks of paper of distinct thicknesses or spiral coils different in diameter.

Additionally, actuation device A in the above embodiment comprises two electromagnetic devices 5 (FIG. 3), each of which links one of push-pull members 51 and supplies power to push-pull members 51 for outward or inward movement.

In the above embodiment, actuation device A comprises at least a convey belt 46 (FIG. 2) which is connected between an output shaft 47 of motor 3 and a spindle 49 of rotary drum 25 and used in conveying a rotary force of motor 3 to rotary drum 25 for rotation.

In the above embodiment, actuation device A comprises a baffle 48 and a sensor 44 (FIGS. 3 and 12). Baffle 48 is installed on mobile platform 2 and driven with touch switch 32; sensor 44 is mounted on mobile platform 2; baffle 48 is shifted with touch switch 32, which is contacted by spiral coil 42 and shifted upward, and blocks sensor 44 for deactivating motor 3 by a signal from sensor 44.

above descriptions are examples of preferred embodiments which do not restrict scope of a semi-automatic book sewing machine; any equivalent change or improvement without departing from spirit of semi-automatic book sewing machine should be incorporated in claims herein. Many changes and modifications in the above described embodiment of invention can, of course, be carried out without departing from the scope thereof. Accordingly, to promote progress in science and useful arts, the present invention is disclosed and is intended to include all embodiments within scope of appended claims.

What is claimed is:

1. A semi-automatic book sewing machine, comprising:

a base with a book storage region, a spiral coil storage region and a coiling rack thereon and a base fixture block at one side;

an actuation device with a mobile platform, a motor, a rotary drum, a bottom panel, a manual adjustment kit, two slip joint plates, a linkage, at least a push-pull member, a binder plate and a touch switch, wherein the mobile platform which is opposite to and glidingly contacts the base has a first elliptical hole, and wherein the motor is installed on the mobile platform for output of a rotary force, and wherein the rotary drum mounted on the mobile platform and connected to the motor is driven to spin locally by the motor, wherein the bottom panel installed on the bottom of the mobile platform develops a second elliptical hole and comprises a panel fixture block at one side; the manual adjustment kit comprising a shaft;

a first cam eccentrically connected to the shaft and held in the first elliptical hole;

a second cam eccentrically connected to the shaft and held in the second elliptical hole; and a rotary knob connected to and coacting with the shaft is used in driving the mobile platform and the bottom panel for displacement;

the two slip joint plates glidingly contact both the base and the mobile platform; the linkage is connected between the two slip joint plates; the push-pull members are connected to the linkage for outward and inward movements back and forth; the binder plate pivotally fitted at the linkage communicates with the push-pull members for pivotal compression and separation under effect of the push-pull members; the touch switch installed on the mobile platform is used to control and deactivate the motor when the touch switch is contacted.

2. The semi-automatic book sewing machine according to claim 1, wherein the base comprises a thickness measurement region which consists of indents varying in width and longitudinally linking one another.

3. The semi-automatic book sewing machine according to claim 1, wherein the base has longitudinal grooves, transverse grooves and lifting grooves extending at both sides, and wherein the mobile platform at both sides has arc-shaped grooves and transverse slippery columns contiguously slipping in transverse grooves of the base, each of the slip joint plates allows a lifting stud to slide in the arc-shaped groove and the lifting groove for curve movement along the arc-shaped groove and vertical slides along the lifting groove, each of slip joint plates comprises at least a longitudinal sliding stud contiguously slipping in the longitudinal groove, and the linkage, the push-pull members, and binder plate vertically move along the lifting grooves and the longitudinal grooves, making no translational movement related to the mobile platform.

4. The semi-automatic book sewing machine according to claim 1, further comprising a housing mounted on the base and used to cover the actuation device, which has the rotary knob rotationally installed on the housing and operated by a user.

5. The semi-automatic book sewing machine according to claim 1, wherein the actuation device further comprises at least an electromagnetic device which links one of the push-pull members and supplies power to the push-pull member for outward or inward movement.

6. The semi-automatic book sewing machine according to claim 1 wherein the actuation device further comprises at least a convey belt which is connected between an output shaft of the motor and a spindle of the rotary drum and used in conveying a rotary force of the motor to the rotary drum for rotation.

7. The semi-automatic book sewing machine according to claim 1, wherein the actuation device further comprises a baffle and a sensor, wherein the baffle is installed on the mobile platform and driven with the touch switch; and wherein the sensor is mounted on the mobile platform such that the baffle is shifted with the touch switch causing contact by a spiral coil and reby shifted upward so as to block the sensor for deactivating the motor by a signal from the sensor.

* * * * *